US012778248B2

(12) United States Patent
Hansen et al.

(10) Patent No.: US 12,778,248 B2
(45) Date of Patent: Nov. 3, 2026

(54) CARGO CARRYING DEVICE

(71) Applicant: Super Tote LLC, Arvada, CO (US)

(72) Inventors: Brian Hansen, Arvada, CO (US); Kris Hansen, Arvada, CO (US)

( * ) Notice: Subject to any disclaimer, the term of this patent is extended or adjusted under 35 U.S.C. 154(b) by 0 days.

(21) Appl. No.: 18/928,478

(22) Filed: Oct. 28, 2024

(65) Prior Publication Data

US 2025/0151865 A1 May 15, 2025

Related U.S. Application Data

(60) Provisional application No. 63/598,124, filed on Nov. 12, 2023.

(51) Int. Cl.

| | |
|---|---|
| ***A45C 5/04*** | (2006.01) |
| ***A45C 13/02*** | (2006.01) |
| ***A45C 13/26*** | (2006.01) |
| ***A45C 13/30*** | (2006.01) |

(52) U.S. Cl.

CPC ..... *A45C 5/045* (2013.01); *A45C 13/02* (2013.01); *A45C 13/26* (2013.01); *A45C 13/30* (2013.01)

(58) Field of Classification Search

CPC ..... A45C 5/045; A45C 13/02; A45C 13/26; A45C 13/30

USPC ..... 383/16; 190/100

See application file for complete search history.

(56) References Cited

U.S. PATENT DOCUMENTS 5,528,840 A * 6/1996 Pajak ..... A47L 23/20 34/235
5,607,237 A * 3/1997 LaFleur ..... B65D 88/1681 383/17
6,478,463 B2 11/2002 Snider
D506,060 S 6/2005 Achilles
D758,731 S 6/2016 Noh
9,409,679 B2 8/2016 Rumbough et al.
(Continued)

FOREIGN PATENT DOCUMENTS

WO WO 2008154583 12/2008
WO WO 2016210377 12/2016

OTHER PUBLICATIONS

Brightline Bags Main Handle—MyPilotStore.com available at https://www.mypilotstore.com/mypilotstore/sep/8717 at least as early as Aug. 29, 2023, 2 pages.

(Continued)

*Primary Examiner* — Nathan J Jenness
*Assistant Examiner* — Jessica Kavini Tamil
(74) *Attorney, Agent, or Firm* — Trenner Law Firm, LLC; Mark Trenner

(57) ABSTRACT

A cargo carrying device is disclosed including a substantially rectangular bottom panel, a substantially rectangular front panel, a substantially rectangular back panel, substantially rectangular first and second side panels. The front panel, the back panel, and the first and second side panels are each connected to the bottom panel. A polyhedron cargo compartment is formed between the front panel, the back panel, the first side panel, the second side panel, and the bottom panel. Packages and/or other items may be loaded into the cargo compartment for transport. The cargo carrying device has at least one rigid handle for carrying. At least one support strap is connected to the first side panel, the bottom panel, and the second side panel. The support strap is also connected to the rigid handle.

14 Claims, 10 Drawing Sheets

(56) References Cited

U.S. PATENT DOCUMENTS

| | | | | |
|---|---|---|---|---|
| 11,006,714 | B2 | 5/2021 | Gaye | |
| 2004/0208397 | A1 | 10/2004 | Yi | |
| 2007/0025647 | A1 | 2/2007 | Hamlin | |
| 2007/0127852 | A1 * | 6/2007 | Town | B65D 88/1618 383/18 |
| 2008/0142558 | A1 | 6/2008 | Dexter | |
| 2009/0039621 | A1 | 2/2009 | Parmenter | |
| 2009/0101253 | A1 | 4/2009 | Kinskey et al. | |

OTHER PUBLICATIONS

Errand Boy Extra Large Tote Bag | SCOUT Bags available at https://scoutbags.com/products/errand-boy at least as early as Aug. 29, 2023, 6 pages.

Shopping Bags—Rigid Handle Tote Bags—Action Plastic Sales available at https://www.actionplasticsales.com/rigid-handle-tote-bags/ at least as early as Aug. 29, 2023, 4 pages.

* cited by examiner

CARGO CARRYING DEVICE

PRIORITY CLAIM

This application claims the priority filing benefit of U.S. Provisional Patent Application No. 63/598,124 filed Nov. 12, 2023 for "Cargo Carrying Device" of Brian Hansen and Kris Hansen, hereby incorporated by reference in its entirety as though fully set forth herein.

BACKGROUND

There are nearly two million active sellers on Amazon that need to take their products to delivery services such as the U.S. Postal Service (USPS), United Parcel Service (UPS), and Federal Express (FEDEX) for shipment. These sellers typically take their products in various bags, such as plastic or cloth shopping bags.

Plastic bags, while convenient, have significant disadvantages. They can be easily damaged, especially by heavy objects or the sharp edges of the packages being transported. Additionally, plastic bags may not provide adequate protection for fragile items, leading to potential breakage or loss. The environmental impact of single-use plastic bags is also a growing concern, as they contribute to pollution and waste.

Cloth tote bags may also be used. These bags are reusable and more environmentally friendly than plastic bags. However, cloth tote bags have limitations, particularly in terms of capacity and protection for the packages being carried. They may not be suitable for larger or heavier packages.

While different package carrying methods are used to cater to various needs, considerations such as package size and weight, cost, and environmental impact all play roles in determining the best choice for specific situations.

DETAILED DESCRIPTION

Figure 1:
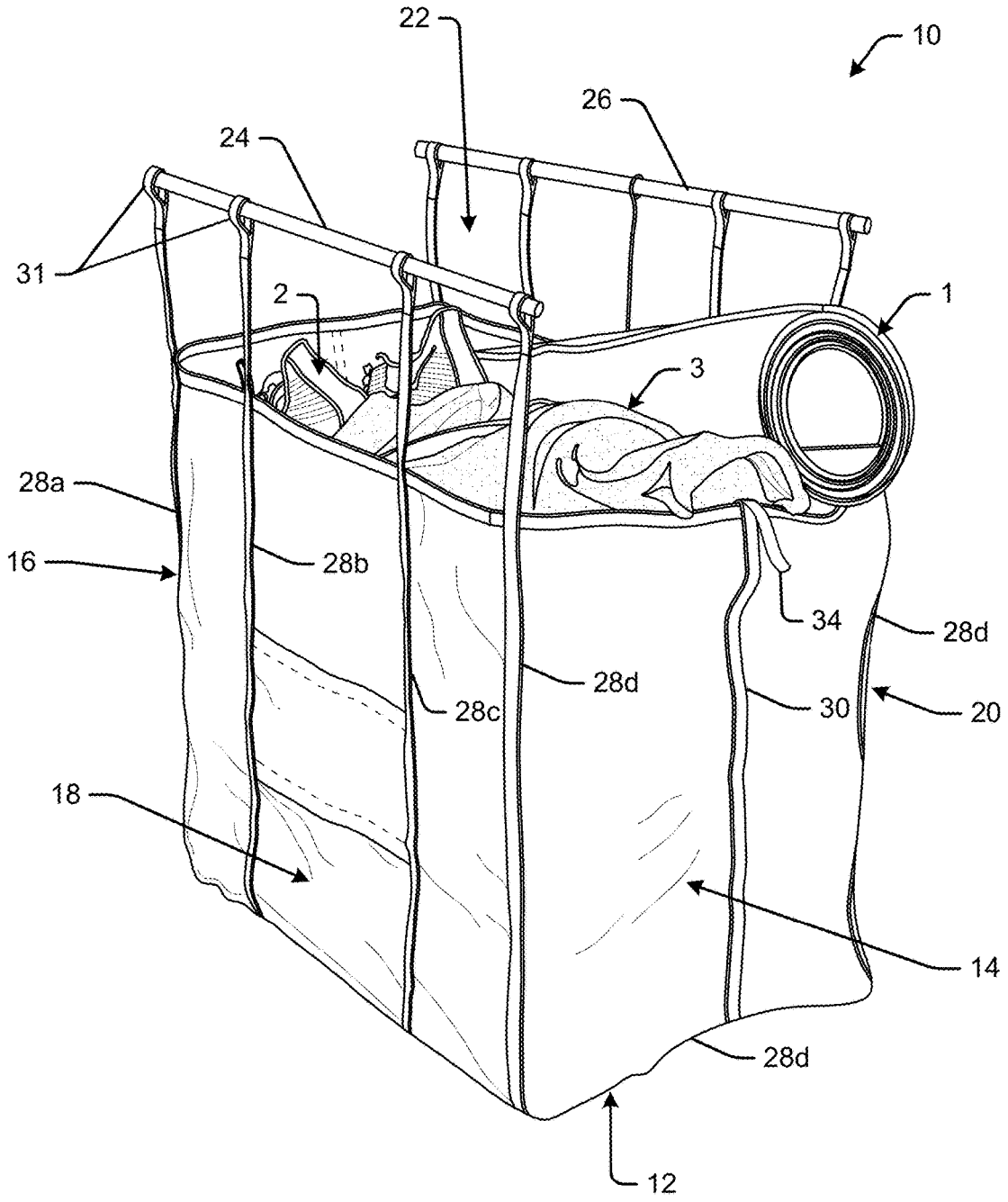
FIG. 1 is an isometric view of an example cargo carrying device with various items illustrated therein for transport.

A cargo carrying device is disclosed as it may be implemented to carry packages and/or other items (e.g., "cargo"). In an example, the cargo carrying device includes a substantially rectangular bottom panel, a substantially rectangular front panel, a substantially rectangular back panel, and substantially rectangular first and second side panels. The front panel, the back panel, and the first and second side panels are each connected to the bottom panel. A polyhedron cargo compartment is formed between the front panel, the back panel, the first side panel, the second side panel, and the bottom panel. Packages and/or other items may be loaded into the cargo compartment for transport. The cargo carrying device has at least one rigid handle for carrying. At least one support strap is connected to the first side panel, the bottom panel, and the second side panel. The support strap is also connected to the rigid handle.

In an example, the rigid handles are attached to strapping that goes around the sides and bottom for support. Strapping is at least located on the front and back panels, and may also be provided on the sides for supporting the cargo and for better handling during transport of the cargo. More strapping can be provided, for example, if additional support for weight and size is needed. The strapping attached to rigid handles makes the opening larger to make it easier for loading and unloading the cargo.

Rigid handles provides a safer transport of the cargo because, in most cases, a person will carry the cargo carrying device with one hand instead of two hands, For example, the user may handle the cargo carrying device with only one hand while carrying a box or boxes, laundry basket, and/or other odd shaped items that can fit in the bag. The user's other hand can remain free to manage other obstacles (e.g., to open a door, grab on to a hand rail for safety, or to use a phone). Two people may also each take a separate handle to help carry heavier loads.

The example cargo carrying device provides better cargo carrying for any kind of cargo, including but not limited to, packages, laundry, shopping/groceries, sports activities, picnics, site clean up, etc. The example cargo carrying device may help save the user's back from otherwise having to carry objects from the front, by shifting the weight of the cargo to the side where a person can better carry loads safer and easier.

Before continuing, it is noted that as used herein, the terms "includes" and "including" mean, but is not limited to, "includes" or "including" and "includes at least" or "including at least." The term "based on" means "based on" and "based at least in part on."

It is also noted that the examples described herein are provided for purposes of illustration, and are not intended to be limiting. Other devices and/or device configurations may be utilized to carry out the operations described herein.

The operations shown and described herein are provided to illustrate example implementations. It is noted that the operations are not limited to the ordering shown. Still other operations may also be implemented.

FIG. 1 is an isometric view of an example cargo carrying device 10 with various items (e.g., yoga mat 1, shoes 2, and clothing 3) illustrated therein for transport in the bag-like structure. An example of the cargo carrying device 10 includes a bag structure having a bottom panel 12, a front panel 14, a back panel 16, and first and second side panels 18 and 20, respectively. Each of the front, back, and side panels are substantially rectangular in shape, and connected to the bottom panel 12, and to each other on the sides to form a polyhedron cargo compartment 22 (see, e.g., FIG. 2).

The example cargo carrying device 10 also includes a rigid first handle 24 connected to the first side panel 18, and a rigid second handle 26 connected to the second side panel 20.

The example cargo carrying device 10 also includes a plurality of support straps 28*a-d*. The support straps 28*a-d* are connected to the first and second side panels 18 and 20, and the bottom panel 12. One or more cross straps 30 may also be connected to the front panel 14, the back panel 16, and the bottom panel 12. In an example, the support straps 28*a-d* and cross strap(s) 30 extend across all three panels to provide support for carrying heavier cargo in the cargo compartment 22.

Figure 2:
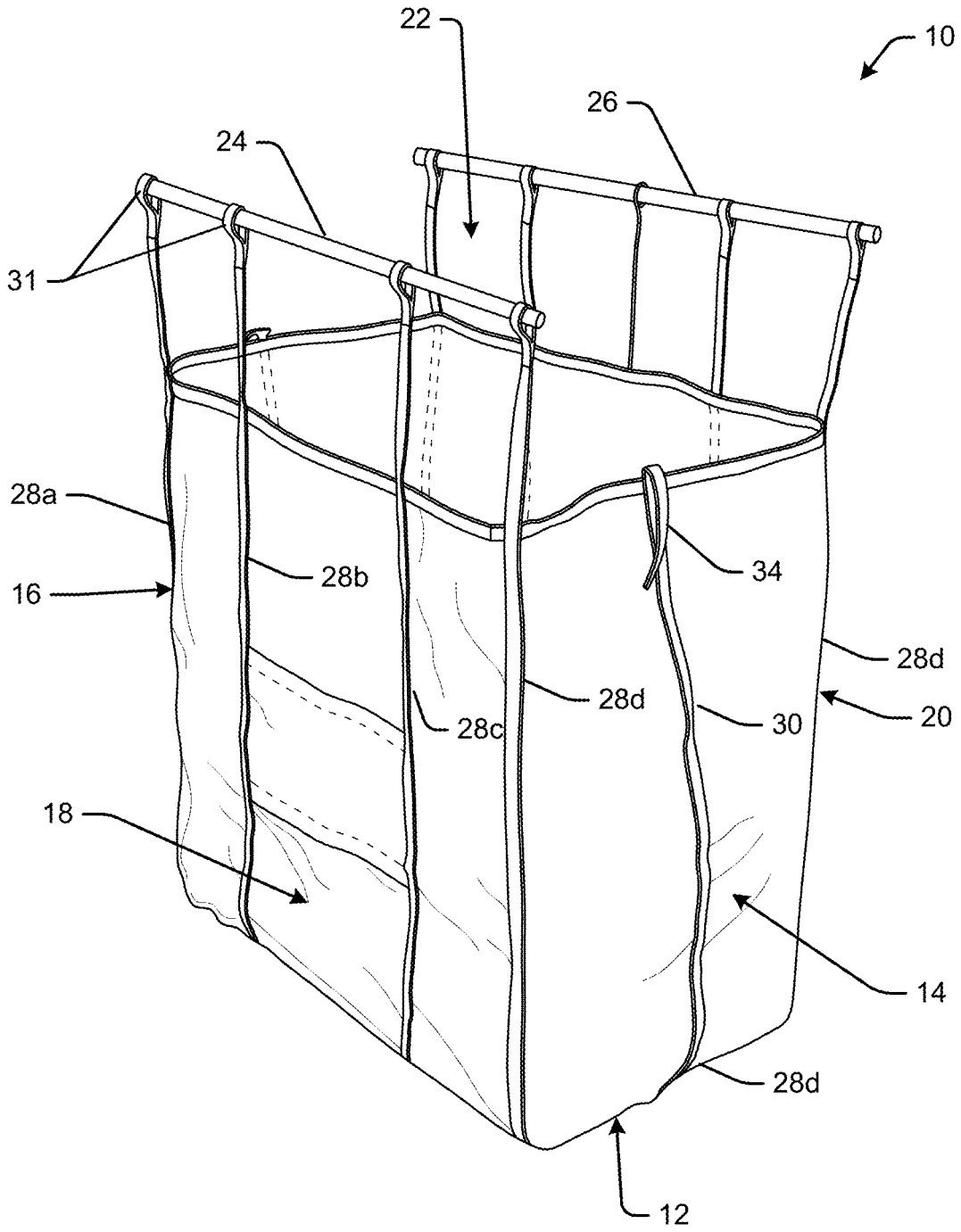
FIG. 2 is an isometric view of the example cargo carrying device of FIG. 1 without the various items shown therein.
Figure 3:
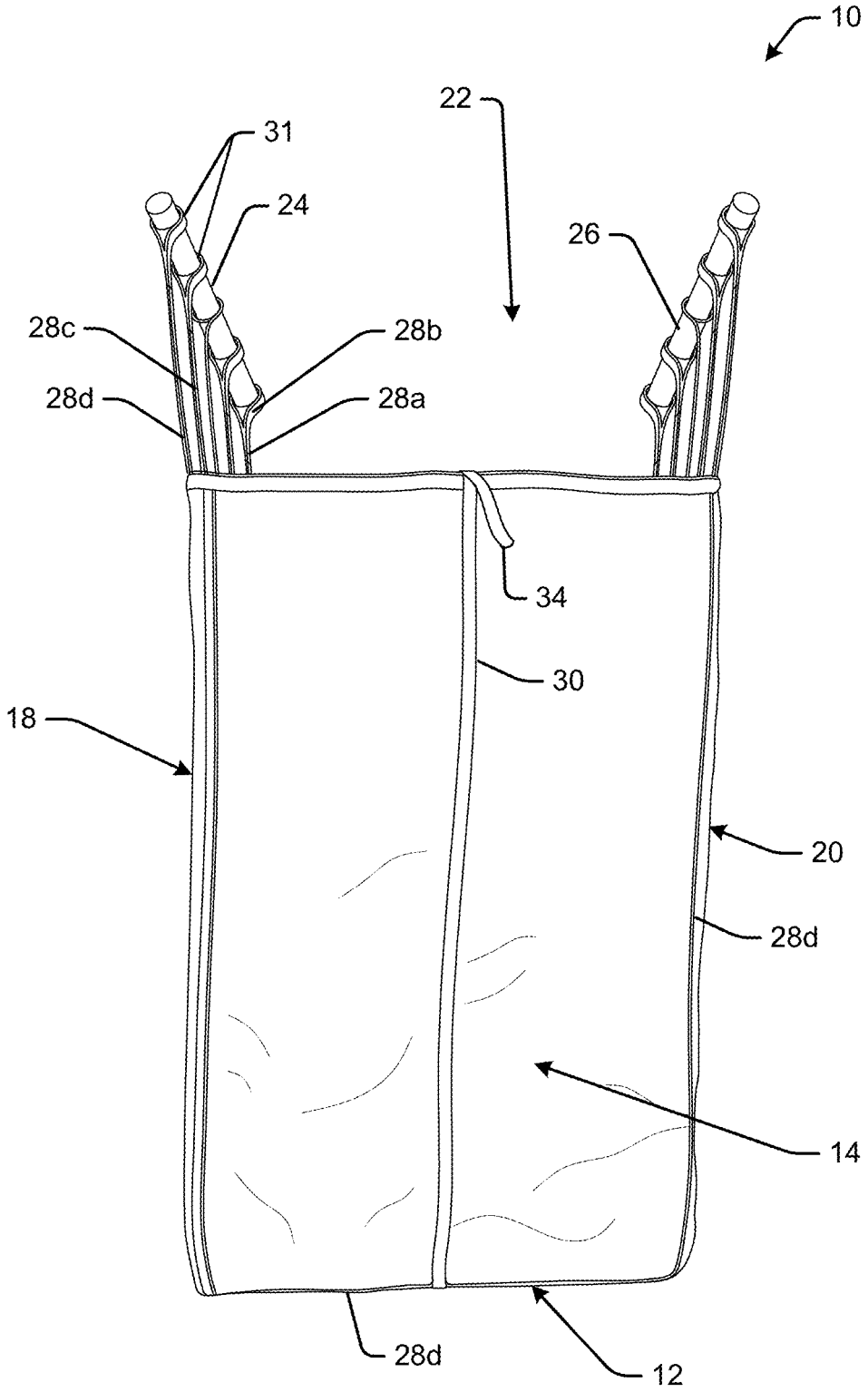
FIG. 3 is a front view of the example cargo carrying device corresponding to FIG. 2.
Figure 4:
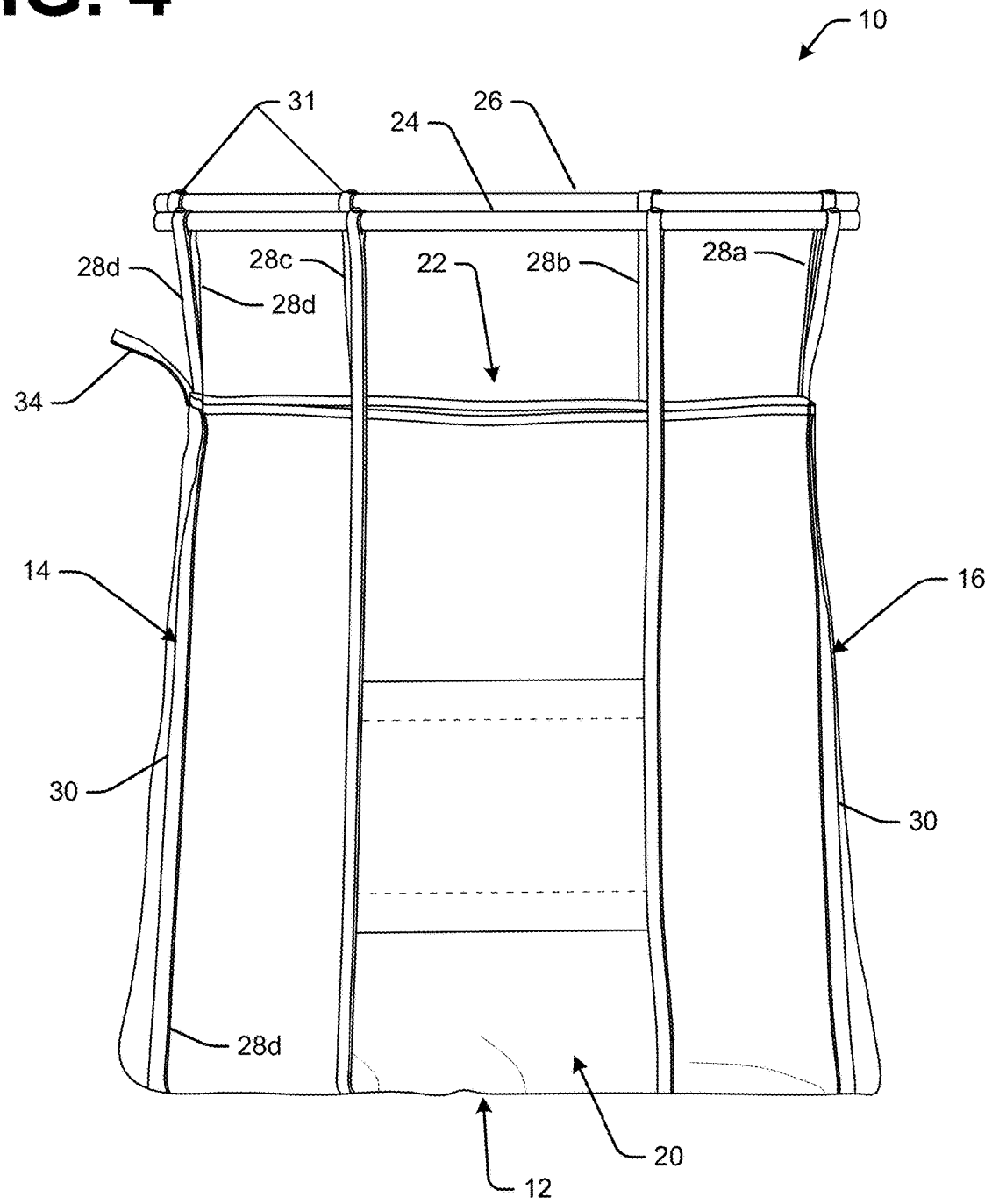
FIG. 4 is a side view of the example cargo carrying device corresponding to FIG. 2.

FIG. 2 is an isometric view of the example cargo carrying device 10 of FIG. 1 without the various items shown therein. FIG. 3 is a front view of the example cargo carrying device 10 corresponding to FIG. 2. FIG. 4 is a side view of the example cargo carrying device 10 corresponding to FIG. 2.

The example cargo carrying device 10 includes a bottom panel 12, front panel 14, back panel 16, and first and second side panels 18, 20. These panels are each connected to the bottom panel 12 and to each other to form a cargo compartment 22.

The example cargo carrying device 10 includes at least one rigid handle (two rigid handles 24 and 26 are shown in the drawings). One or more side support straps (four support straps 28*a-d*) are connected to the first side panel 18, across the bottom panel 12, and the second side panel 20. The side support straps 28*a-d* connect the rigid handles 24 and 26 to the panels. In an example, at least one cross support strap 30 is connected to the front panel, across the bottom panel, and the back panel. The side support straps 28*a-d* and the cross support strap(s) 30 provide additional strength, e.g., for carrying heavy loads and reducing wear and tear.

In an example, the strap ends of the side support straps 28*a-d* each form loops 31 to receive the rigid handles 24, 26 therethrough. A plurality of fasteners 32 (see, e.g., FIG. 10) connect the loops 31 of the side support straps 28*a-d* to the respective rigid handles 24, 26 so that the handles 24, 26 do not slide relative to the side support straps 28*a-d*. The fasteners 32 may be any suitable fastener. Example fasteners include, but are not limited to, temporary or removable fasteners, such as hook-and-loop or VELCRO™, snaps, and buttons, to name only a few examples. Example fasteners also include more permanent fasteners, such as screws or rivets to fixedly connect the side support straps 28*a-d* to the rigid handles 24, 26.

In an example, at least one drag strap 34 is connected on one of the front panel, back panel, or two side panels. The drag strap 34 may be part of the cross strap 30 (e.g., an extended portion of the cross strap 30). In another example, the drag strap 34 may be a separate strap attached to one or more of the panels. The drag strap 34 may be provided in any suitable position(s) on the bag structure. In an example, the drag strap 34 is provided near the top of the front and/or back panel of the bag structure, as shown in FIG. 1. But the drag strap 34 may be provided in the middle, on the bottom, and/or any other location on any of the panels of the bag structure.

The drag strap 34 enables the user to grasp and pull or drag the loaded cargo carrying device 10 out of a vehicle (e.g., the back of a truck or cargo area of an SUV, or across a seat, etc.). The drag strap provides strength and durability, and also reduces undue stress on the outer material of the bag structure when being pulled on. In the example shown in FIG. 1, the drag strap 34 spans from the end panels and underneath the bottom of the bag structure. The drag strap may be sewn or otherwise connected to the bag structure to aid in less snagging.

Figure 5:
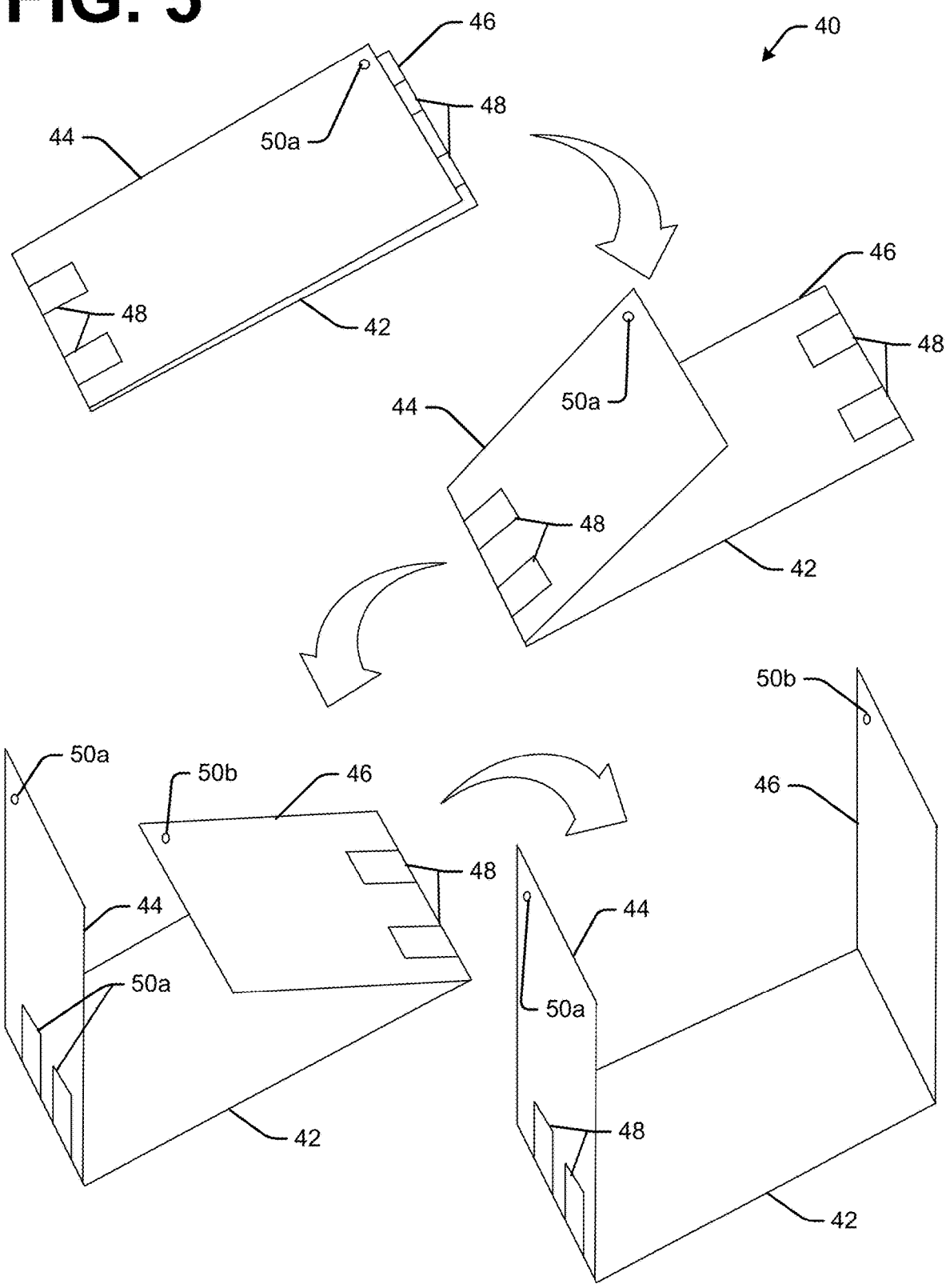
FIG. 5 shows an example frame support of the cargo carrying device, illustrating the frame support being opened from a collapsed configuration into a working configuration.

FIG. 5 shows an example frame support or rigid board structure 40 of the cargo carrying device 10, illustrating the frame support being opened from a collapsed configuration into a working configuration. In an example, the frame support or rigid board structure 40 has a rigid bottom board 42 corresponding to the inside bottom panel 12 of the cargo carrying device 10. A rigid first side board 44 is connected to the bottom board 42. A rigid second side board 46 is also connected to the bottom board 12 (on the opposite side). In an example, one or more hinges 48 connect the side board 44, 46 to the bottom board.

Figure 6:
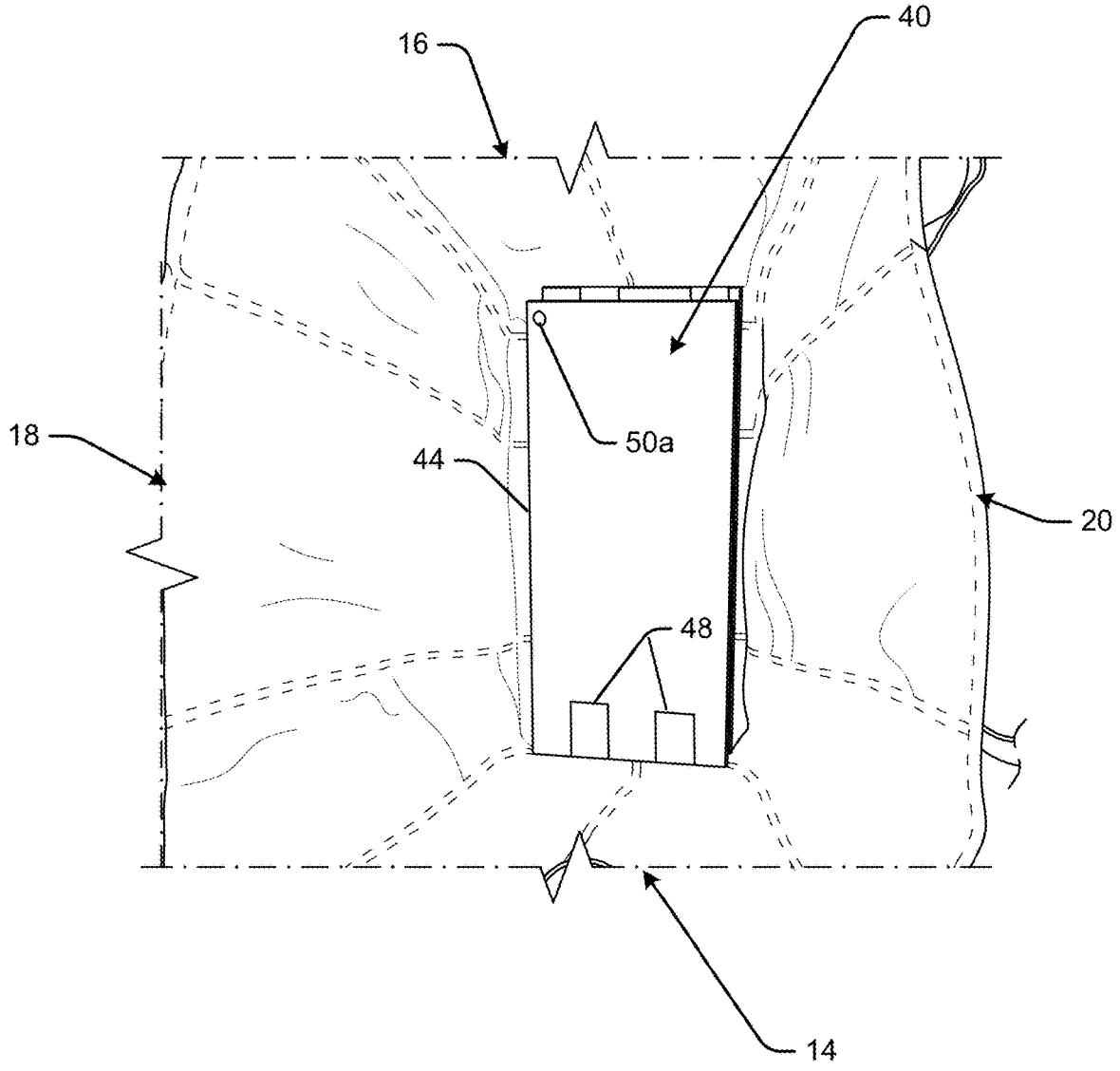
FIGS. 6-8 illustrate implementation of the frame support of FIG. 5 inside of the cargo carrying device.
Figure 7:
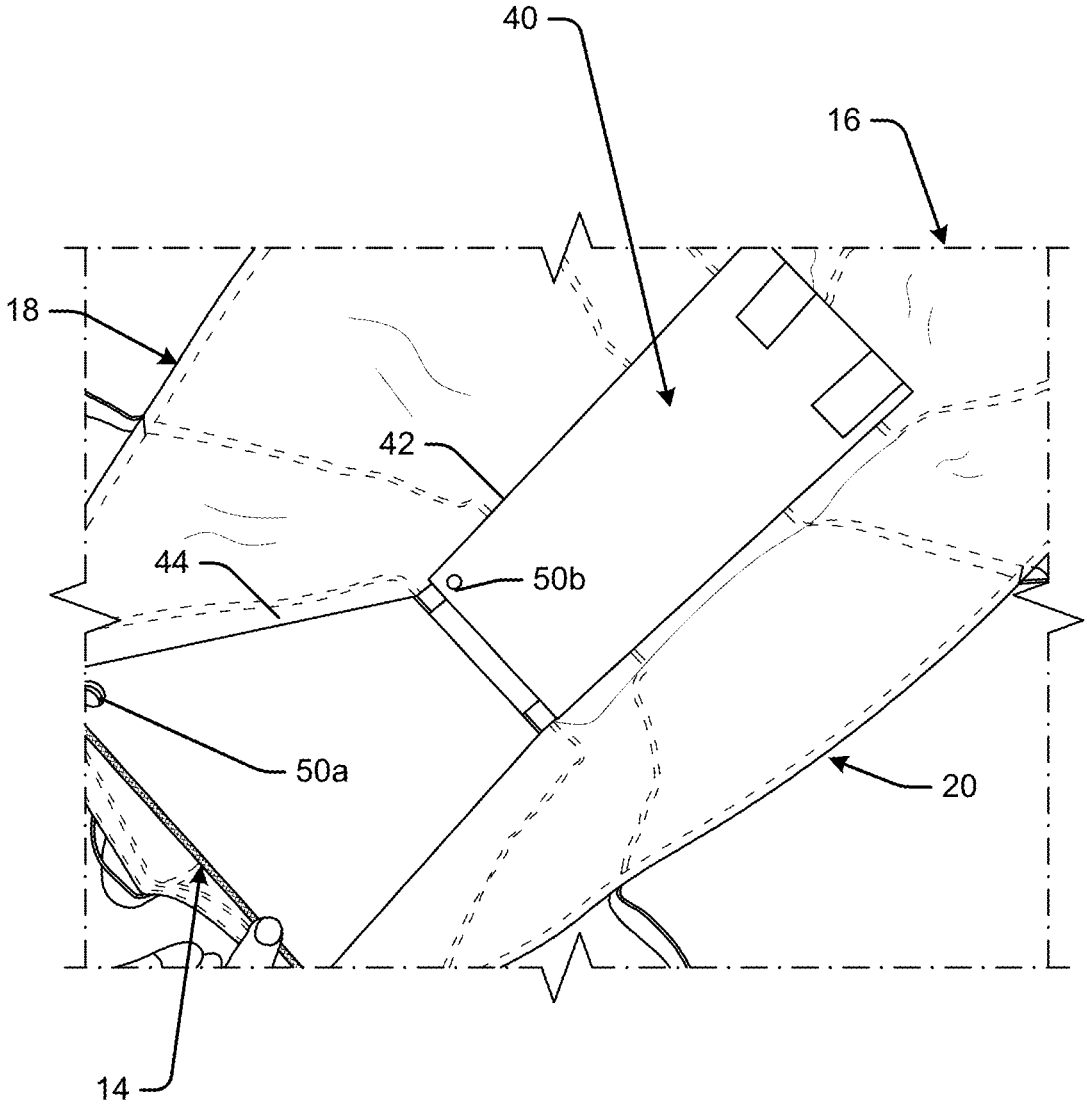
Figure 8:
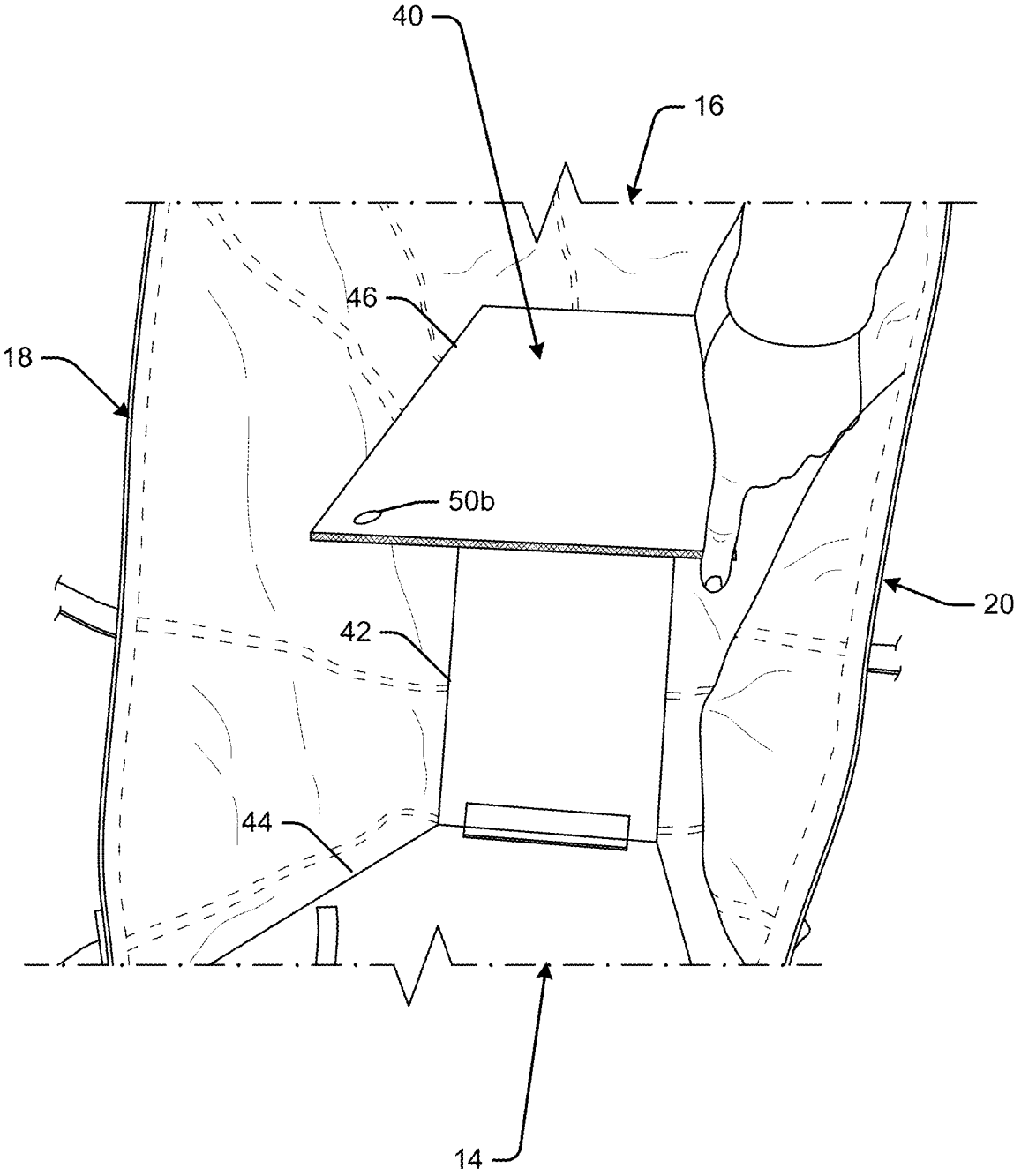

During use, the first side board 44 is foldable between a collapsed configuration and an open configuration, as illustrated in FIG. 5. FIGS. 6-8 illustrate implementation of the frame support of FIG. 5 inside of the cargo carrying device 10. In the open configuration, the first side board 44 is positioned against one of the panels (e.g., panel 16) of the bag structure. The second side board 46 is also foldable between a collapsed configuration and an open configuration. In the open configuration the second side board 46 is positioned against another panel (e.g., panel 14). The substantially upright configuration of the frame support 40 situates the cargo compartment 22 of the bag structure as a freestanding structure, e.g., for loading and/or unloading packages or other items in the cargo carrying device 10.

In an example, a first opening 50*a* (e.g., a hole having a diameter that is larger than the rigid handle 24 or 26) is formed in the first side board 44. A second opening 50*a* (e.g., a hole having a diameter that is larger than the rigid handle 24 or 26) is formed in the second side board 46. The first and second openings are configured to receive opposite ends of one of the rigid handles (e.g., handle 26).

Figure 9:
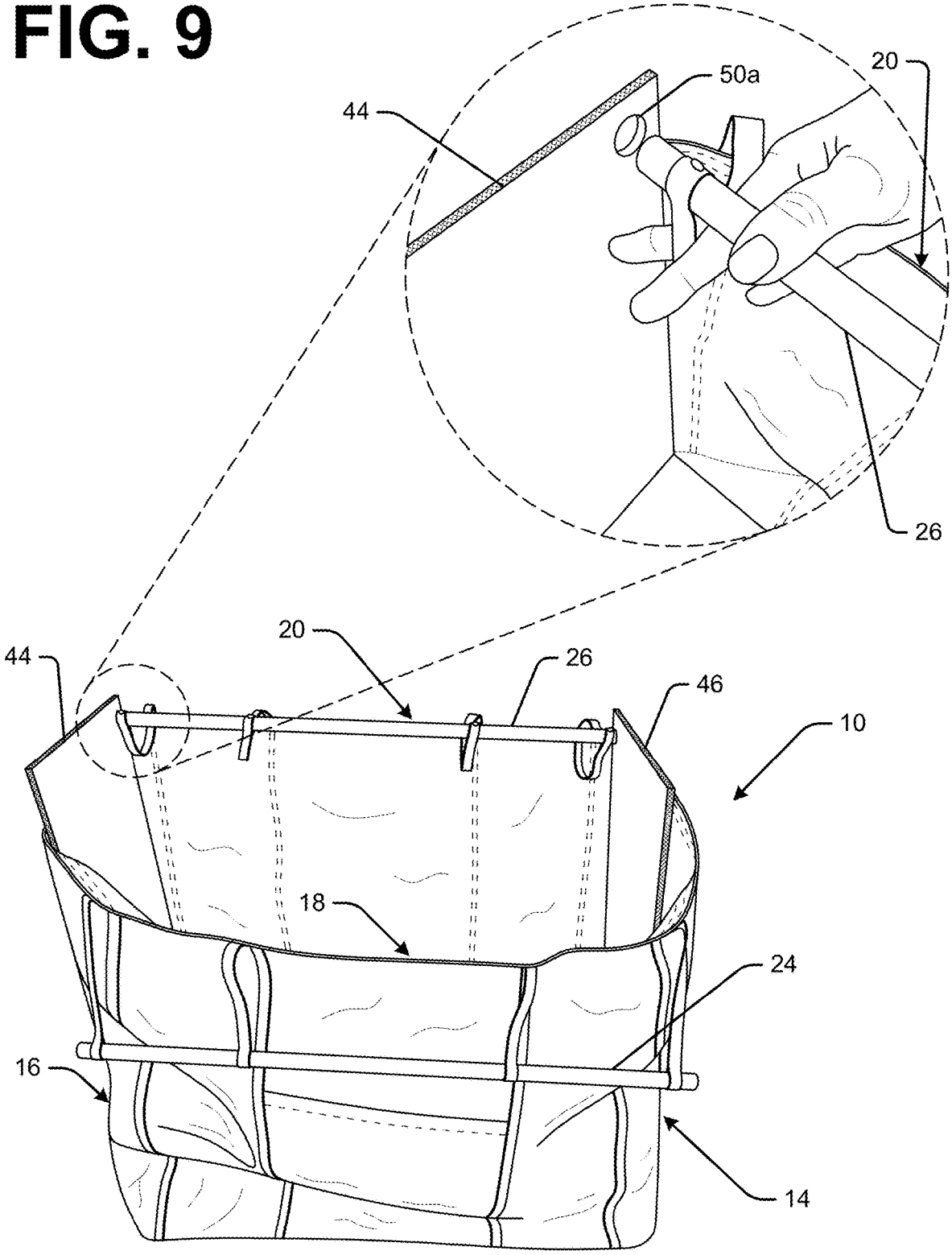
FIG. 9 is a close-up view showing assembly of a handle in the frame support on one side of a top opening of the cargo carrying device, while the opposite side provides an enlarged opening for loading packages into the cargo carrying device.

FIG. 9 is a close-up view showing assembly of a handle 26 in the frame support 40 on one side of a top opening of the cargo carrying device 10. This configuration holds up the bag structure on one side (panel 20) of the cargo compartment 22, while the other side (panel 18) drops out of the way to provide an enlarged opening for loading packages into the cargo carrying device 10.

Figure 10:
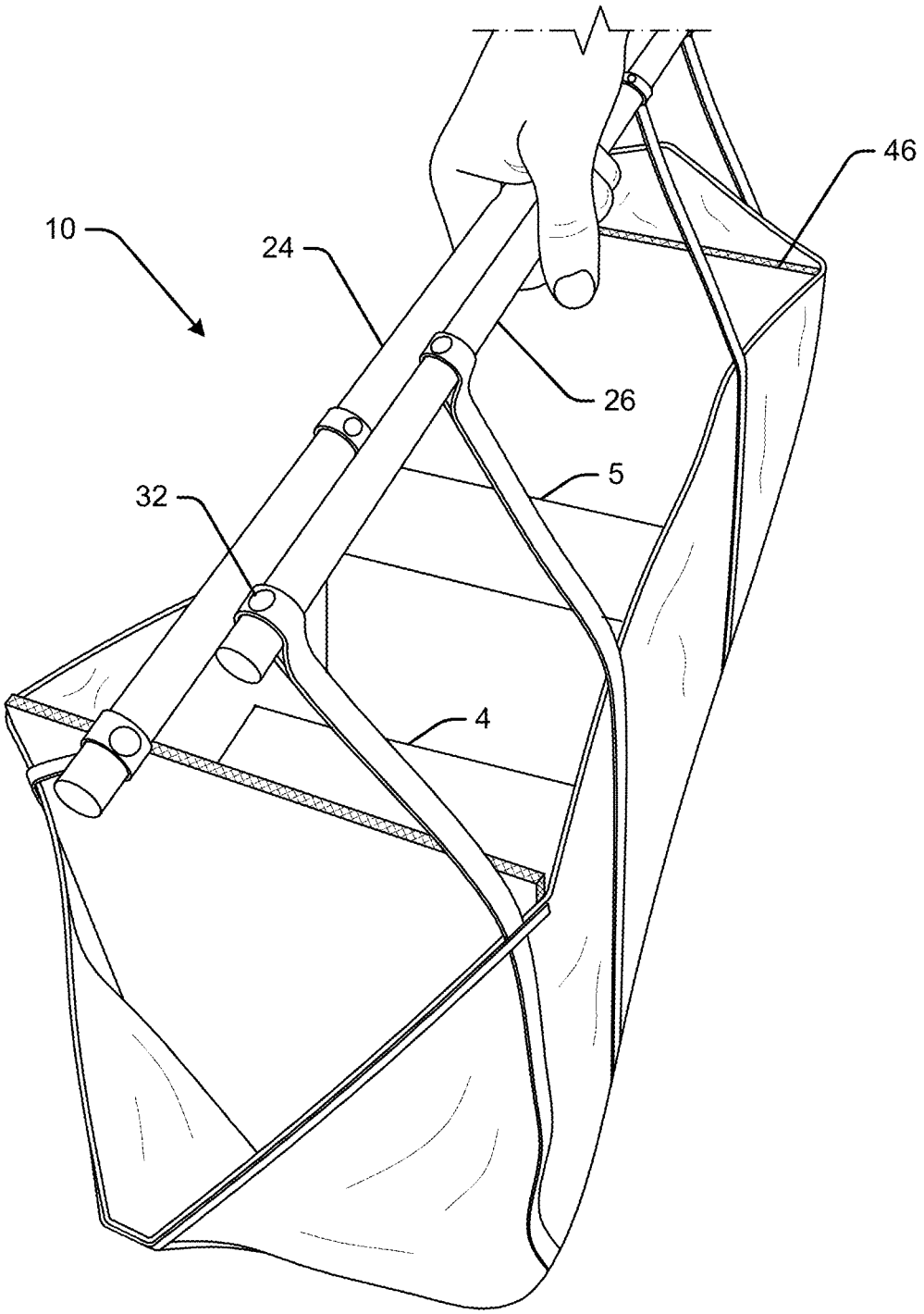
FIG. 10 is an illustration of the example cargo carrying device as it can be picked up and carried with packages therein.

FIG. 10 is an illustration of the example cargo carrying device 10 as it can be picked up and carried with packages (or other items) placed therein. In an example, a box 4 can be added in the cargo compartment 22 of the bag structure. Then an oversized box 5 can be added that is taller than the entire bag and handle. With the flexible top, combined with the handle and strapping, the oversized box 5 can fit into the cargo compartment 22, and the entire cargo carrying device 10 can still easily be carried.

The example cargo carrying device 10 enables a user to carry cargo easier, safer and more efficiently. The design allows for carrying larger loads with fewer trips. By way of illustration, the example cargo carrying device 10 may help when taking boxes to the shipping carrier. If the user has more than a handful of boxes, a person otherwise would have to make several trips back and forth before getting into the line. But using the example cargo carrying device 10, the user can carry much more than a handful of boxes, thereby saving time and effort.

The example cargo carrying device 10 may also be used when moving from home to home, home to college or traveling. The example cargo carrying device 10 helps reduce the amount of trips from a car to house, car to a dorm room (which can be a long hike), car to hotel room, etc.

The example cargo carrying device 10 can also be used at construction sites. Construction site clean up can be a time killer. The example cargo carrying device 10 can carry a large amount of odd sized "stuff" (e.g., insulation, odd sized waste lumber, and all the little stuff) that takes more time in handling and carrying individually to a dumpster. As such, the example cargo carrying device 10 can help save in labor cost.

The example cargo carrying device 10 can also aid in many other chores involving transporting cargo manually. The examples discussed herein are merely for purposes of illustration and are not intended to be limiting.

As noted above, the example cargo carrying device 10 has one or more rigid handles 24, 26. The handles 24, 26 can intertwine with each other to hold the top of the bag structure in place. The bag structure and handles 24, 26 are configured to stay in place with a full load so that the bag does not readily fall over. In addition, the straps 28*a-d* attach to the handle 24, 26 and can be adjusted for shorter people, e.g., by rolling both handles 24, 26 to shorten the length of the straps 28*a-d*.

The example cargo carrying device 10 also has a rigid bottom, which helps provide better support and handling. The top opening of the bag structure remains open, with no frame, thus making it flexible for ease of loading and unloading the cargo. The top of the example cargo carrying device 10 flexes and molds around the cargo. The strapping 28*a-d* is designed to go under the rigid bottom for greater support and ease of handling cargo.

The example cargo carrying device 10 may also have a handle hook. The handle hook can be hung over the back of a chair or door knob, etc. The hook may serve as an "additional hand" to aid in holding the bag open while the user is loading cargo into the bag.

The combination of the rigid handles 24, 26, the strapping 28*a-d*, and the rigid bottom (and sides), combine to provide for more storage area so larger loads can be handled easier than any other bag available. When not in use, the example cargo carrying device can be rolled up into a compact shape for storage.

It is noted that the examples shown and described are provided for purposes of illustration and are not intended to be limiting. Still other examples are also contemplated.

The invention claimed is:

1. A cargo carrying device comprising:

a substantially rectangular bottom panel;

a substantially rectangular front panel and a substantially rectangular back panel, the front panel and the back panel each connected to the bottom panel;

a substantially rectangular first side panel and a substantially rectangular second side panel, the first side panel and the second side panel each connected to the bottom panel;

a polyhedron cargo compartment formed between the front panel, the back panel, the first side panel, the second side panel, and the bottom panel;

at least one rigid handle;

at least one side support strap connected to the first side panel, the bottom panel, and the second side panel, the at least one side support strap connected to the at least one rigid handle;

a rigid bottom board on the bottom panel;

a rigid first side board connected to the bottom board and foldable between a collapsed configuration and an open configuration, wherein in the open configuration the first side board is positioned against the front panel;

a rigid second side board connected to the bottom board and foldable between a collapsed configuration and an open configuration, wherein in the open configuration the second side board is positioned against the back panel; and a first opening formed in the first side board, and a second opening formed in the second side board, the first and second openings configured to receive opposite ends of one of the at least one rigid handle and retain one of the first or second side panels in a substantially upright configuration for loading packages and/or other items into the cargo compartment.

2. The cargo carrying device of claim 1, further comprising two rigid handles.

3. The cargo carrying device of claim 2, further comprising at least two side support straps each connected to the first side panel, the bottom panel, and the second side panel, the at least two side support straps connected on separate strap ends to each of the two rigid handles.

4. The cargo carrying device of claim 3, further comprising four side support straps each connected to the first side panel, the bottom panel, and the second side panel, the at least four side support straps connected on separate strap ends to each of the two rigid handles.

5. The cargo carrying device of claim 3, further comprising a plurality of fasteners connecting the at least two side support straps to each of the two rigid handles.

6. The cargo carrying device of claim 5, wherein the plurality of fasteners fixedly connect the at least two side support straps to each of the two rigid handles so that the two rigid handles do not slide relative to the at least two side support straps.

7. The cargo carrying device of claim 5, wherein separate strap ends of the at least two side support straps each form loops to receive the two rigid handles therethrough.

8. The cargo carrying device of claim 1, further comprising at least a first hinge connecting the first side board to the bottom board, and at least a second hinge connecting the second side board to the bottom board.

9. The cargo carrying device of claim 1, wherein the substantially upright configuration situates the cargo compartment as a freestanding structure.

10. The cargo carrying device of claim 9, wherein the other of the first or second side panels is lower than the side panel retained in the substantially upright configuration to provide a larger opening to the cargo compartment.

11. The cargo carrying device of claim 1, further comprising at least one cross support strap connected to the front panel, the bottom panel, and the back panel.

12. The cargo carrying device of claim 1, further comprising at least one drag strap connected on one of the front panel, back panel, or two side panels.

13. A cargo carrying device comprising:

a substantially rectangular bottom panel;

a substantially rectangular front panel and a substantially rectangular back panel, the front panel and the back panel each connected to the bottom panel;

a substantially rectangular first side panel and a substantially rectangular second side panel, the first side panel and the second side panel each connected to the bottom panel;

a polyhedron cargo compartment formed between the front panel, the back panel, the first side panel, the second side panel, and the bottom panel;

a rigid first handle connected to the first side panel;

a rigid second handle connected to the second side panel;

a plurality of support straps connected to at least one the first and second side panels, the front and back panels, and the bottom panel; and a rigid board structure for defining and strengthening the cargo compartment, the rigid board structure having a rigid bottom board, a rigid first side board pivotally connected on a first edge of the rigid bottom board, and a rigid second side board pivotally connected on a second edge of the rigid bottom board; and a first opening formed in the first side board, and a second opening formed in the second side board, the first and second openings configured to receive opposite ends of the first rigid handle to retain one of the first or second side panels in a substantially upright configuration for loading packages and/or other items into the cargo compartment.

14. The cargo carrying device of claim 13, wherein in an open configuration of the rigid board structure, the first side board is positioned against the front panel, and the second side board is positioned against the back panel.

* * * * *